US005278585A

United States Patent [19]

Karz et al.

[11] Patent Number: 5,278,585

[45] Date of Patent: Jan. 11, 1994

[54] INK JET PRINTHEAD WITH INK FLOW DIRECTING VALVES

[75] Inventors: Robert S. Karz, Webster; James F. O'Neill, Penfield; Joseph J. Daniele, Pittsford, all of N.Y.

[73] Assignee: Xerox Corporation, Stamford, Conn.

[21] Appl. No.: 889,584

[22] Filed: May 28, 1992

[51] Int. Cl.[5] ..... B41J 2/05; B41J 2/055

[52] U.S. Cl. ..... 346/140 R

[58] Field of Search ..... 346/140

[56] References Cited

U.S. PATENT DOCUMENTS

| | | | |
|---|---|---|---|
| 4,463,359 | 7/1984 | Ayata et al. | 346/1.1 |
| 4,496,960 | 1/1985 | Fischbeck | 346/140 |
| 4,752,788 | 6/1988 | Yasuhara | 346/140 |
| 4,774,530 | 9/1988 | Hawkins | 346/140 R |
| 5,053,787 | 10/1991 | Terasawa | 346/140 X |
| 5,072,241 | 10/1991 | Shibaike et al. | 346/140 R |

FOREIGN PATENT DOCUMENTS 100169 7/1980 Japan .

OTHER PUBLICATIONS

Hawkins et al; Sideshooter with High Frequency Response; Xerox Disclosure Journal, V14, N3, May/Jun. 1989, pp. 105-107.

*Primary Examiner*—Joseph W. Hartary
*Attorney, Agent, or Firm*—Robert A. Chittum

[57] ABSTRACT

A thermal ink jet printhead has a flow directing one-way valve for reducing back-flow directed forces generated by the droplet ejecting ink vapor bubbles, so that most of the bubble generated forces are used to eject ink droplets from the printhead nozzles. The one-way valve is provided by patterning the etch resistant mask to form a flap located at a predetermined position along the ink channels between the heating elements and reservoirs, which is activated by bubble generated forces directed in the opposite direction from the printhead nozzles.

4 Claims, 7 Drawing Sheets

INK JET PRINTHEAD WITH INK FLOW DIRECTING VALVES

BACKGROUND OF THE INVENTION

This invention relates to thermal ink jet printheads for use in an ink jet printer, and more particularly to such printheads having ink flow directing valves to reduce back flow caused by vaporized ink bubbles used to expel ink droplets from printhead nozzles.

In existing thermal ink jet printing, the printhead comprises one or more ink filled channels, such as disclosed in U.S. Pat. No. 4,463,359 to Ayata et al., communicating with a relatively small ink supply chamber at one end and having an opening at the opposite end, referred to as a nozzle. A thermal energy generator, usually a resistor, is located in the channels near the nozzles a predetermined distance therefrom. The resistors are individually addressed with a current pulse to momentarily vaporize the ink and form a bubble which expels an ink droplet. As the bubble grows, the ink bulges from the nozzle and is contained by the surface tension of the ink as a meniscus. As the bubble begins to collapse, the ink still in the channel between the nozzle and bubble starts to move towards the collapsing bubble, causing a volumetric contraction of the ink at the nozzle and resulting in the separation of the bulging ink as a droplet. The acceleration of the ink out of the nozzle while the bubble is growing provides the momentum and velocity of the droplet in a substantially straight line direction towards a recording medium, such as paper.

One problem with this thermal ink jet process is that the bubble growth is symmetrical, thus forcing as much ink towards the supply reservoir in the printhead as is driven out of the channels through the nozzles in the forms of droplets. The droplet velocity of the ejected droplets could be increased, if the pressure force produced by the bubbles were preferentially directed towards the printhead nozzles. This control of the bubble force directions would reduce the required power, improve droplet directionality, decrease the printhead heating during operation, and thus improve printhead energy efficiency.

U.S. Pat. No. 5,072,241 to Shibaike et al. discloses a roofshooter type ink jet printhead having a shutter which either aligns an aperture with the printhead nozzles or covers the printhead nozzles. A series of electrodes on opposite sides of the shutter cause the shutter to move and be electrostatically held in one of the two desired locations.

U.S. Pat. No. 4,774,530 to Hawkins discloses a thermal ink jet printhead which comprises an upper and a lower substrate that are mated and bonded together with a thick film insulative layer sandwiched therebetween. One surface of the upper substrate has etched therein one or more grooves and a recess which, when mated with the lower substrate, will serve as capillary-filled ink channels and ink supplying manifold, respectively. The grooves are open at one end and closed at the other end. The open ends will serve as the nozzles. The manifold recess is adjacent the groove closed ends. Each channel has a heating element located upstream of the nozzle. The heating elements are selectively addressable by input signals representing digitized data signals to produce ink vapor bubbles. The growth and collapse of the bubbles expel ink droplets from the nozzles and propel them to a recording medium. Recesses patterned in the thick film layer expose the heating elements to the ink, thus placing each of them in a pit, and provide a flow path for the ink from the manifold to the channels through an elongated trench, thereby enabling the ink to flow around the closed ends of the channels. The trench in the thick film layer eliminates the fabrication steps required to open the groove closed ends to the manifold recess, so that the printed fabrication process is simplified.

SUMMARY OF THE INVENTION

It is an object of the present invention to provide a thermal ink jet printhead which will operate with reduced power, increased droplet velocity, and improved directionality.

It is another object of the invention to improve droplet ejection efficiency by controlling the droplet ejecting bubble force directions through the aid of ink directing valves in the printhead channels.

In the present invention, the printhead comprises, for example, a heater plate with heating elements and addressing electrodes and a channel plate with nozzles, a reservoir, and interconnecting channels. The heater plate and channel plate are aligned, mated, and bonded together, usually with a patterned thick film layer sandwiched therebetween as disclosed in U.S. Pat. No. 4,774,530, so that the heating elements are located in pits. A valve in the shape of a flap and being of a material, such as silicon dioxide, silicon nitride, or doped silicon, is formed in the printhead channels during channel fabrication. In one embodiment, a torsional flap is located over the upstream end of the heating element pits, or any other desired location between the heating elements and the ends of the channels adjacent the ink reservoir. In another embodiment, a flap is cantilevered over each end of the channels adjacent the reservoir. In operation, the bubble causes the flap extending over the pits to pivot its distal end towards the channel apex or upper channel portion, so that the flap performs as a one-way valve and substantially blocks the rearward bubble forces and redirects the rearward bubble forces in the opposite direction. The oppositely directed rearward bubble forces become complementary with the forward or droplet ejection direction, thus reducing the droplet ejection force required, and therefore reducing the electrical power for the heating elements.

A more complete understanding of the present invention can be obtained by considering the following detailed description in conjunction with the accompanying drawings wherein like index numerals indicate like parts.

DESCRIPTION OF THE PREFERRED EMBODIMENT

Figure 1:
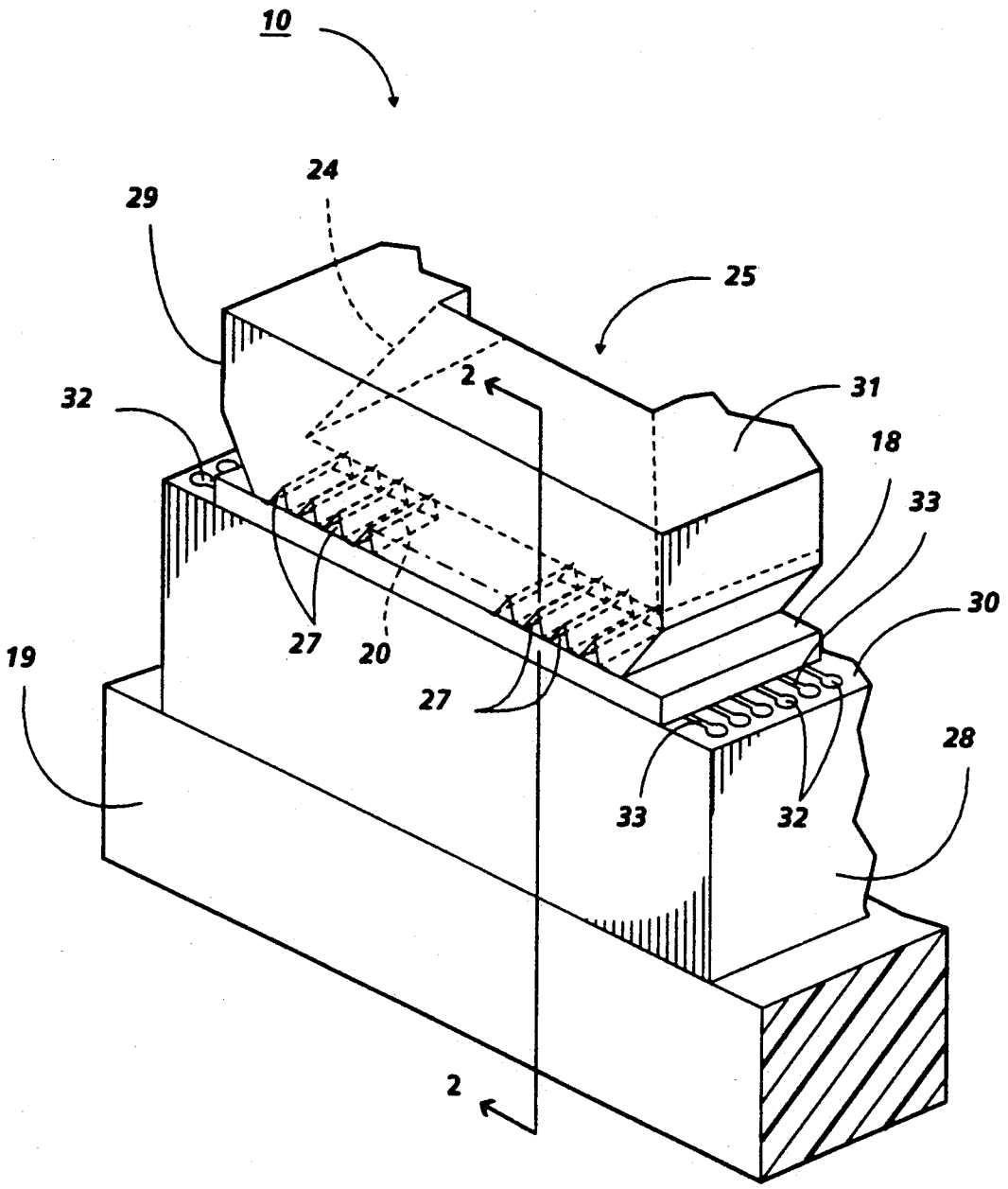
FIG. 1 is an enlarged schematic isometric view of a printhead mounted on a daughter board showing the droplet emitting nozzles.

In FIG. 1, an enlarged, schematic isometric view of a thermal ink jet printhead 10 having ink flow directing valves (see FIG. 2) in the channels thereof is partially shown. The printhead comprises a heater plate 28 having heating elements (not shown in FIG. 1) and addressing electrodes 33 with contact pads 32 formed on surface 30 thereof. A thick film layer 18 of, for example, polyimide, is deposited or laminated over the heating elements and electrodes and patterned to expose the heating elements, placing them in the pits, and to form an ink by-pass trench, better shown in FIG. 2. The channel plate 31 is a silicon substrate photolithographically patterned and anisotropically etched to form a parallel array of channels 20 and reservoir 24, both shown in dashed line. The reservoir is etched through the channel plate and its open bottom serves as an ink inlet 25. One end of the channels is open to produce the printhead nozzles 27, and the other end is adjacent the reservoir and a predetermined distance therefrom. The channel plate 31 is aligned and bonded to the thick film layer, so that each heating element is located in a channel a predetermined distance upstream from the nozzles, and the trench in the thick film layer provides the ink flow path from the reservoir to the channels, as disclosed in U.S. Pat. No. 4,774,530 to Hawkins and incorporated herein by reference in its entirety.

Figure 2:
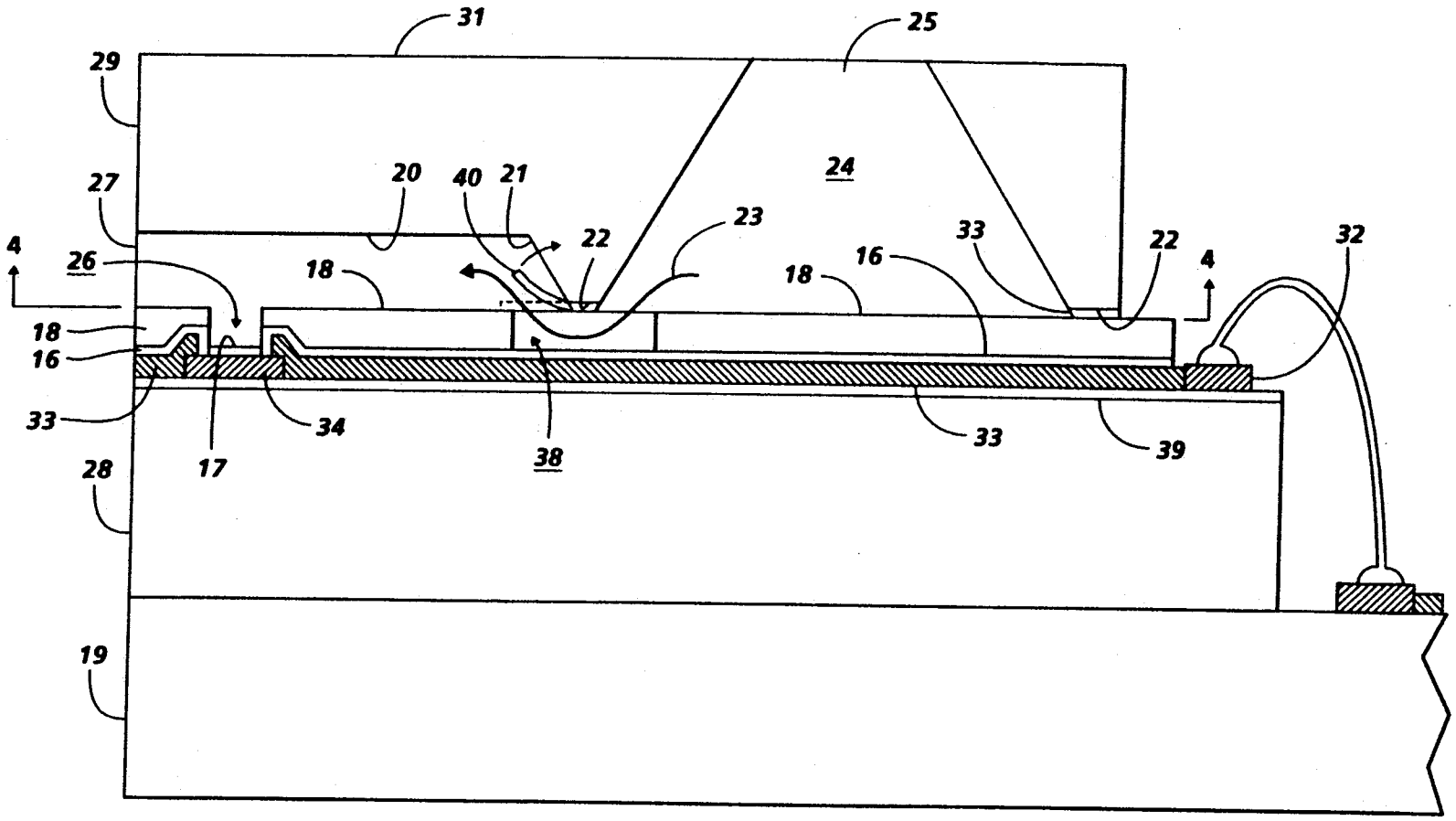
FIG. 2 is an enlarged cross-sectional view of FIG. 1 as viewed along the line 2—2 thereof and showing the ink flow directing valve located adjacent the reservoir, electrode passivation, thick film layer, and ink flow path between the reservoir and the ink channels.

A cross-sectional view of FIG. 1 is taken along view line 2—2 through one channel and shown as FIG. 2 to show how the ink flows from the reservoir 24 and around the end 21 of the groove 20, as depicted by arrow 23, and the flow directing valve 40. Valve 40 comprises a cantilevered finger or flap extending from the surface 22 of the channel plate between the reservoir 24 and the slanted channel end wall 21 for a predetermined distance, generally to a location beyond the edge of the trench 38 in the thick film layer 18. The distal end of the finger has a triangular shape to match the triangular cross-sectional area of the channels. As is disclosed in U.S. Pat. No. 4,774,530 to Hawkins, a plurality of sets of bubble generating heating elements 34 and their addressing electrodes 33 are patterned on one surface of a double side polished (100) silicon wafer (not shown). Prior to patterning the multiple sets of printhead electrodes 33 and the resistive material that serves as the heating elements, the surface of the wafer to contain them is coated with an underglaze layer 39 such as silicon dioxide, having a thickness of about 2 micrometers. The resistive material is a doped polycrystalline silicon which may be deposited by chemical vapor deposition (CVD) or any other well known resistive material such as zirconium boride ($ZrB_2$). The addressing electrodes are typically aluminum leads deposited on the underglaze and over the edges of the heating elements. The addressing electrode terminals or contact pads 32 are positioned at predetermined locations to allow clearance for wire bonding to the electrodes (not shown) of the daughter board 19, after the channel plate 31 is attached to make a printhead. The addressing electrodes 33 are deposited to a thickness of 0.5 to 3 μm with the preferred thickness being 1.5 μm.

In the preferred embodiment, polysilicon heating elements are used and a silicon dioxide layer 17 is grown from the polysilicon in high temperature steam. Before electrode passivation, a tantalum layer (not shown) is preferably deposited to a thickness of about 1 μm for protection against cavitational forces generated by the collapsing ink vapor bubbles during printhead operation. A phosphorous doped CVD silicon dioxide film 16 is deposited over the entire wafer surface including the plurality of sets of heating elements and addressing electrodes to a thickness of about 2 μm. The passivation film is etched off of the heating elements already insulated by oxide layer 17 and electrode contact pads to permit wire bonding later to the daughter board electrodes.

Next, a thick film type insulative layer 18, such as, for example, Riston ®, Vacrel ®, Probimer 52 ®, or polyimide, is formed on the passivation layer 16 having a thickness of between 10 and 100 micrometers. The insulative layer 18 is photolithographically processed to enable etching and removal of those portions of the layer 18 over each heating element (forming pits 26), the elongated recess or trench 38 for providing ink passage from the reservoir 24 to the ink channels 20, and over the electrode contact pads 32.

As disclosed in U.S. Pat. No. 4,774,530, the channel plate is formed from a (100) silicon wafer (not shown) to produce a plurality of channel plates 31 for the printhead. After the wafer is chemically cleaned, a silicon nitride or silicon dioxide layer (not shown) is deposited on both sides. Using conventional photolithography, one side of the wafer is photolithographically patterned to form the relatively large rectangular through recesses 24 with open bottoms 25 and sets of elongated, parallel channel recesses that will eventually become the ink reservoirs and channels of the printheads, respectively. The surface 22 of the wafer containing the reservoirs and channel recesses are portions of the original wafer surface (covered by a silicon dioxide or silicon nitride layer in this invention, though generally removed in prior art printheads) on which adhesive will be applied later for bonding it to the substrate containing the plurality of sets of heating elements. As explained later, the ink flow directing valve 40 is formed from the masking silicon dioxide or silicon nitride layers 36 concurrently when the vias therein are formed in the masking layers to prepare the wafer for anisotropic etching. A final dicing cut, which produces end face 29, opens one end of the elongated groove 20 producing nozzles 27. The other ends of the channel groove 20 remain closed by end 21. However, the alignment and bonding of the channel plate to the heater plate places the ends 21 of channels 20 directly over elongated recess 38 in the thick film insulative layer 18 enabling the flow of ink into the channels from the reservoir as depicted by arrows 23.

The channel wafer is preferably fabricated using the single side, two step etching process as disclosed in U.S. Pat. No. 4,865,560 to Hawkins and incorporated herein by reference in its entirety. In this single side, two step process, the etching masks are formed one on top of the other prior to the initiation of etching, with the coarsest mask formed last and used first. Thus, this mask (not shown) would be used for etching the reservoir, because the reservoir requires that the wafer be etched completely therethrough and necessitates a relatively long etch time of two to three hours in an etchant bath of, for example, KOH. Once the coarse orientation dependent etching is completed, the coarse mask is removed and the finer orientation dependent etching is done. In this application, it is the channels which are the finer etched recesses requiring about 20 to 45 minutes in, for example, EDP. When the single side, two step process is used, the first deposited, finer mask 36 is a patterned layer of silicon dioxide and the last deposited, coarser mask is a patterned layer of silicon nitride.

Figure 4:
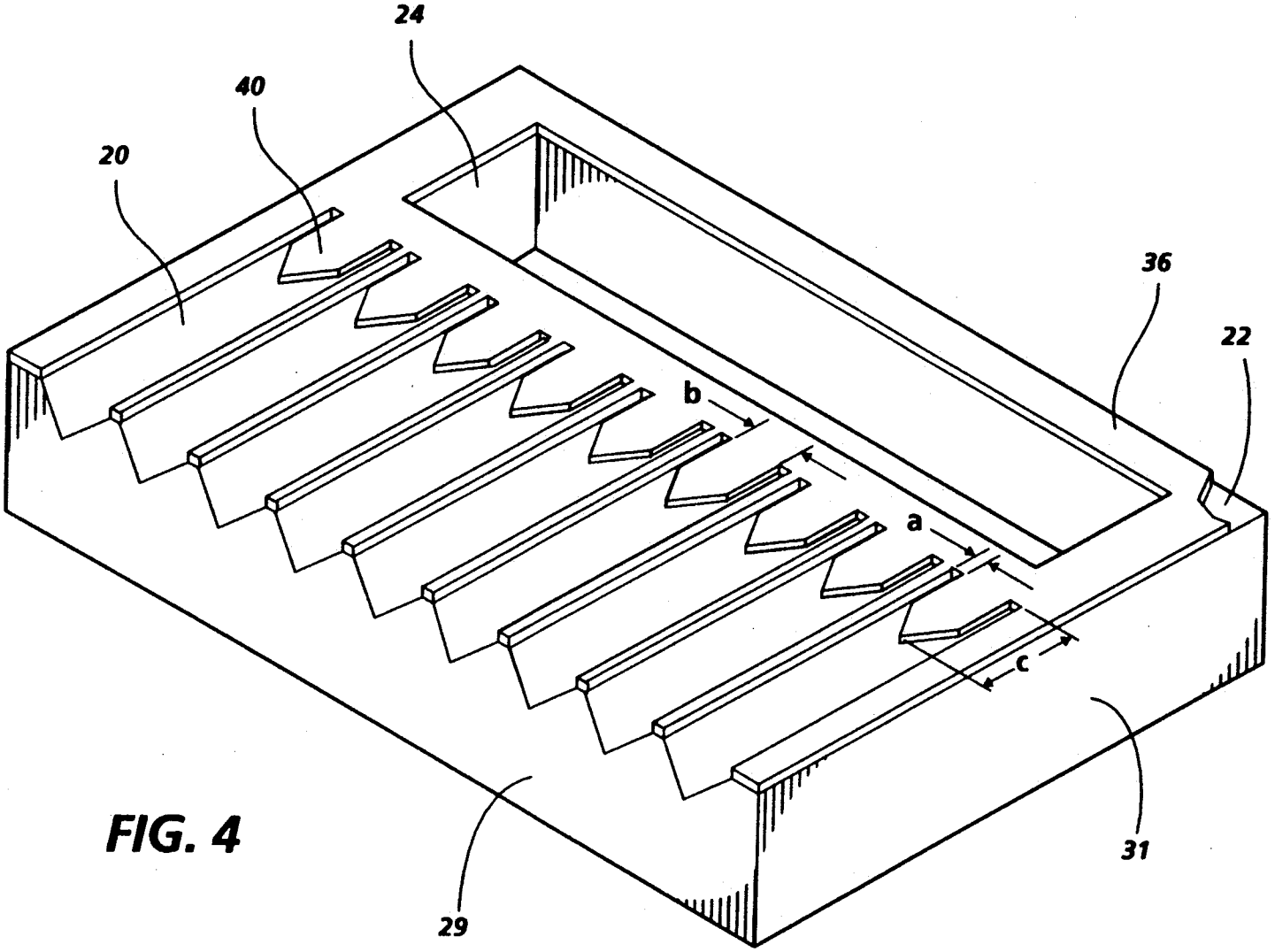
FIG. 4 is an enlarged isometric view of the channel plate as viewed along view line 4—4 in FIG. 2.

FIG. 4 is an enlarged, schematic isometric view of the silicon channel plate 31 as viewed along view line 4—4 of FIG. 2. Surface 22 of the channel plate is covered by the patterned layer 36 of silicon dioxide, a corner of which has been removed to show the bare silicon surface 22. The coarsely etched reservoir 24 extends approximately across the array of parallel channels 20. The flow directing valve 40 is an extended portion or flap of the silicon dioxide layer cantilevered over each closed end of the channels. The surface 22 of the channel plate has the crystalline plane (100) orientation, so that the walls of the channels and reservoir are formed along the {111} crystal planes. The relatively narrow channels have a triangular cross-section with walls which follow the {111} plane at approximately 54.7° with surface 22 and meet at an apex. The width of the channels at the channel plate surface 22 is about 60 μm for a channel spacing of 300 per linear inch. The flow directing valve is formed from the silicon dioxide layer and is isolated from the channels along its length by gaps "a" having a distance of 5 to 10 μm, so that the valve width "b" is about 50 to 40 μm and centered in the channels. The valve length "c" is long enough to extend beyond the edge of the trench 38, so that in the preferred embodiment valve length C is about 80 μm long. The distal end of the valve has a triangular shape to match the triangular cross-section of channels, therefore, enabling the valve 40 to bend towards the apex of the channels without striking the channel walls. Referring also to FIG. 2, the generation of a droplet expelling bubble (not shown) will prevent the pressure forces generated thereby from moving past the flow directing valve, so that most of the forces will be directed towards the nozzles 27. During refill of the channels by capillary action, some of the ink will move around the valve 40 through the gaps on each side, but most of the refill occurs because the valve is flexible and readily bends so that its shaped end pivots toward the channel apex, without significantly impeding its refill time.

Figure 3:
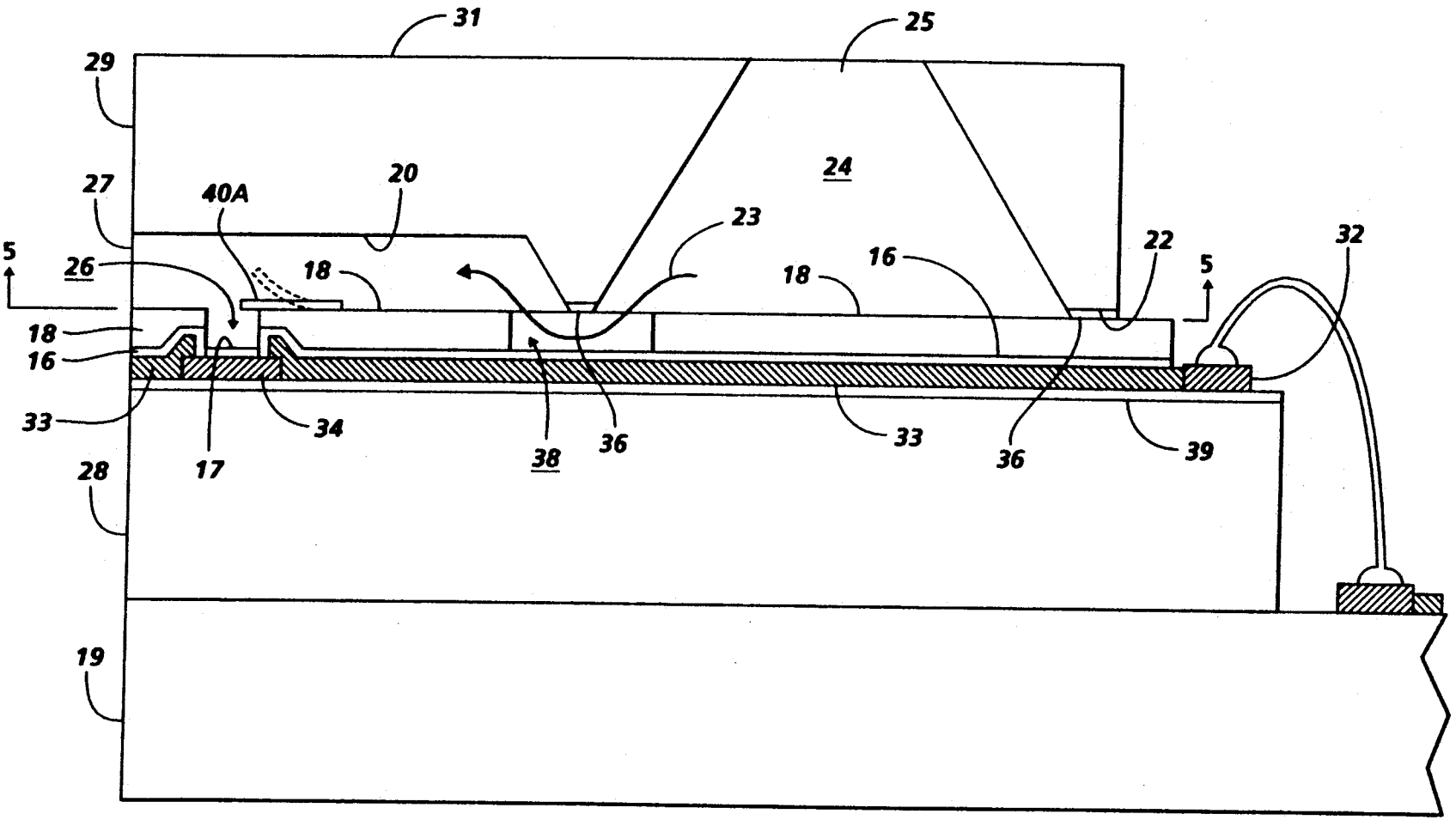
FIG. 3 is the same as FIG. 2 except that the ink flow directing valve is located over the upstream end of the heating element pits.
Figure 5:
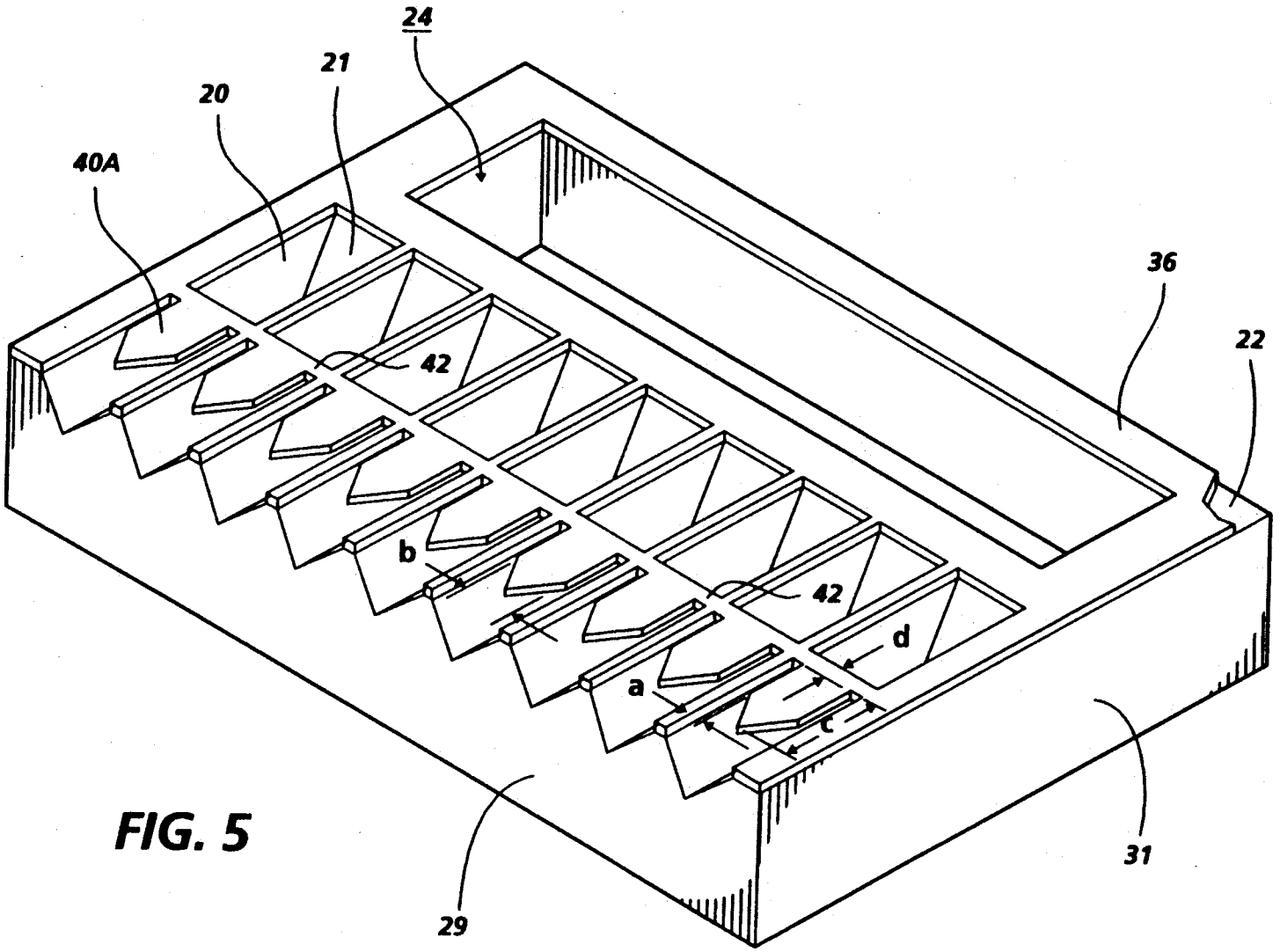
FIG. 5 is similar to FIG. 4, except that the channel plate is viewed along view line 5—5 of FIG. 3.

FIGS. 3 and 5 are similar to FIGS. 2 and 4, respectively, and depict an alternate embodiment of the flow directing valve. In FIG. 3, the valve 40A is similar in size and shape as valve 40 in FIG. 4, except that it extends from a narrow abridging segment 42 of silicon dioxide layer having the width "d", as shown in FIG. 5, of about 6 to 12 μm. Since the mask is underetched during the anisotropic etching of the channels, the channel under the mask segment 42 is undercut then etched away to provide a clear channel from the closed end 21 to the nozzles 27. This valve 40A could be located anywhere along the channel, but is preferably placed with its distal end extending over the pit 26. In this way, the droplet generating bubble (not shown) will cause the valve 40A to torsionally rotate about the segment 42 with its shaped distal end being rotated towards the channel apex. Thus, most of the bubble force directed towards the reservoir is reflected back towards the nozzles. As soon as the bubble begins to collapse, the valve falls back against the thick film layer that forms the channel floor, so that there is substantially no impedance to the channel refill flow and no influence on the channel refill time.

Figure 6:
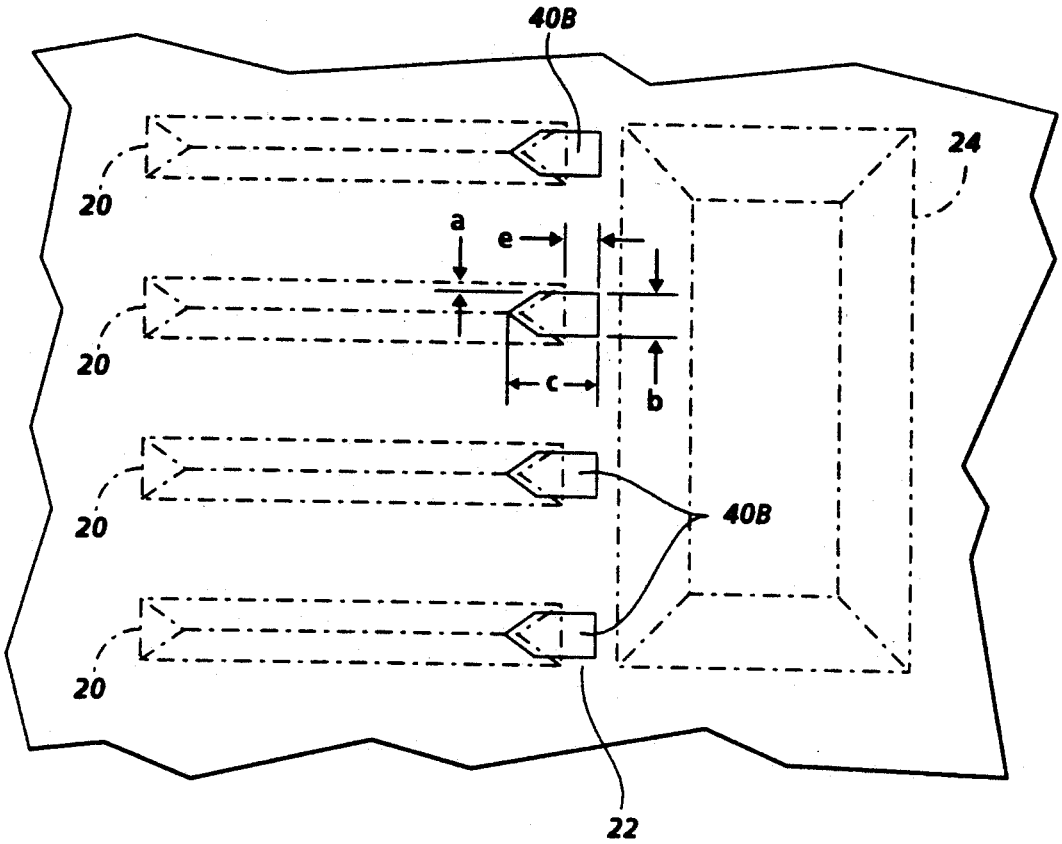
FIG. 6 is a partially shown plan view of an alternate embodiment of the ink flow directing valve shown in FIG. 4.

FIG. 6 is a plan view of a portion of a channel wafer showing the patterning of the flow directing valves 40B from a silicon dioxide layer which have been formed prior to the deposition of the mask layer of silicon nitride which will be used to etch the channels 20 and reservoir 24 shown in dashed line. The dimensions of the valve 40B and the gap "a" are the same as shown in FIG. 4, except that the portion "e" adhering to the wafer surface 22 between the array of channels and the reservoir must be sufficient in length to assure the valve will not become loose during the printhead lifetime. A distance of at least 20 μm or the entire distance between the channels and reservoir must be used.

Figure 7:
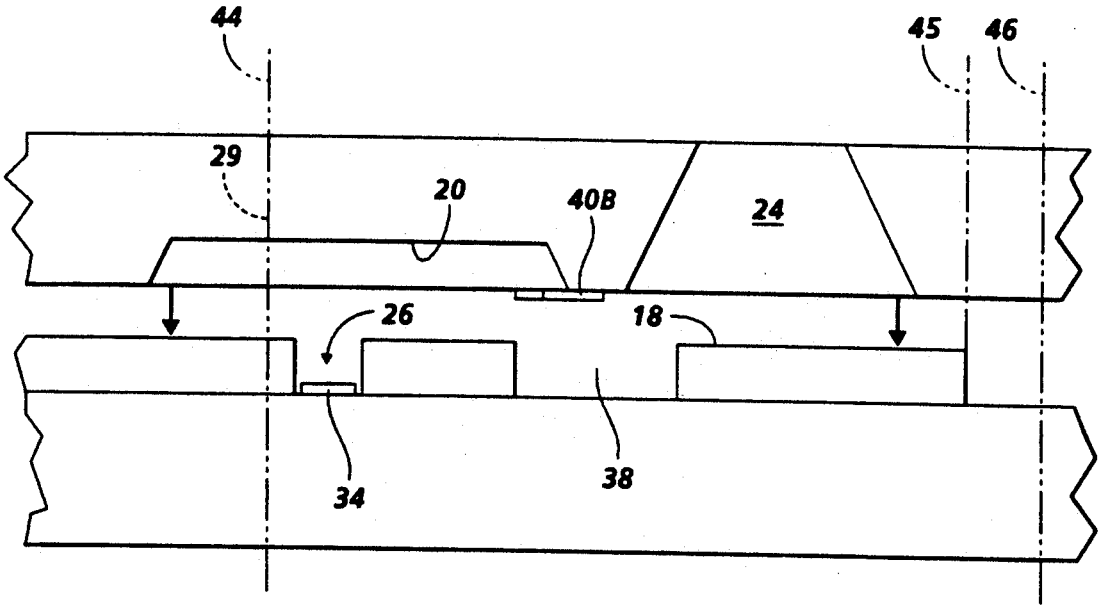
FIG. 7 is a cross-sectional view of the printhead showing ink flow directing valve of the type shown in FIG. 6, just prior to mating of the channel plate with the heating plate.
Figure 8:
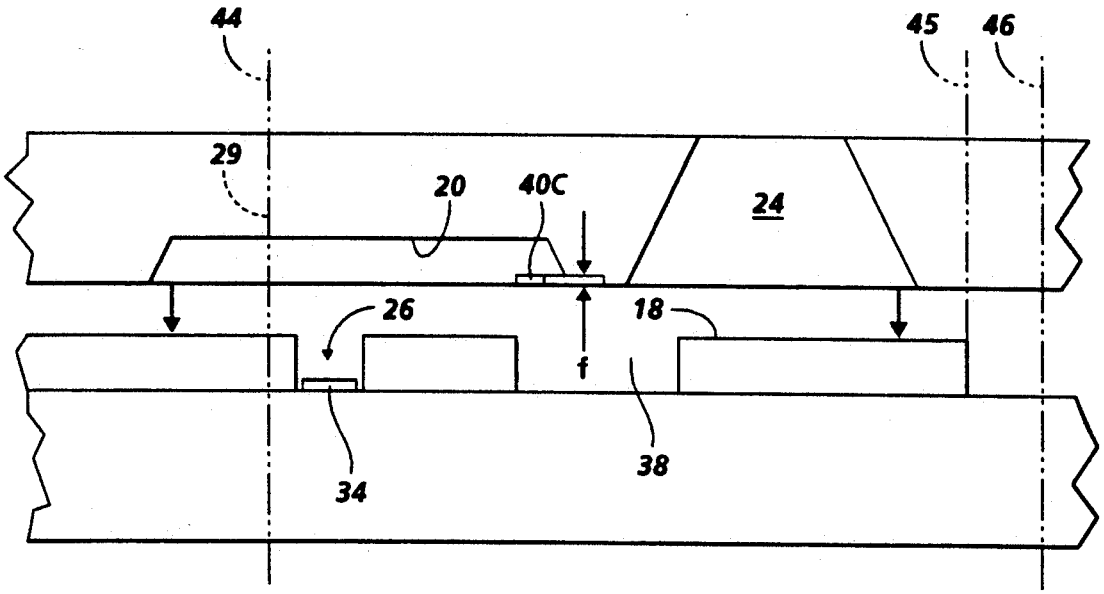
FIG. 8 is similar to FIG. 7, except that it shows another embodiment of the ink flow directing valve.

FIG. 7 is a cross-sectional view of the heater plate wafer and channel plate wafer of FIG. 6 as seen just prior to mating. Dicing lines 44, 45, 46 indicate where the mated wafers will be cut to form a printhead 10. Instead of patterning the flow directing valve of FIG. 6 from silicon dioxide, a similar valve 40C could be formed in the surface portion of the silicon wafer by being implanted or diffused with boron to a concentration of $2\times10^{16}$ per μm. This doped layer of silicon could be generated in the required pattern as shown in FIG. 6 or could be later defined from a uniform implantation. FIG. 8 is an alternate embodiment, similar to FIG. 7, except that the flow directing valve 40C is produced by a patterned etch stop, discussed above, produced by a boron implantation. The doped area will not etch even though the end portion residing in the channel is exposed to the anisotropic etchant through the channel vias in the etch resistant mask layer of silicon nitride or silicon dioxide. The mask layer is subsequently removed, leaving the bare silicon surface 22 and the implanted valve 40C.

In summary, a flow directing check valve is provided to reduce ink back flow during the generation of droplet ejecting bubbles by the thermal ink jet printhead. The valve is produced with little or no change to the printhead fabricating process, and the valve greatly increases front bubble generated forces by the one-way valve action which redirects the rearward directed bubble generated forces towards the nozzles, consequently, increasing droplet velocity, so that droplet directionality is also improved. At the same time, the valve has little or no impact on the channel refill time or droplet generation frequency.

Many modifications and variations are apparent from the foregoing description of the invention, and all such modifications and variations are intended to be within the scope of the present invention.

We claim:

1. A thermal ink jet printhead comprising:

a plurality of nozzles;

an ink reservoir;

ink channels, one for each nozzle, for placing the nozzles in fluid communication with the reservoir, the channels having a predetermined internal cross-sectional shape and a lower internal surface;

selectively addressable heating elements, one heating element located in each channel and in a predetermined position relative to the nozzles;

means for selectively addressing the heating elements with an electrical pulse representative of digitized data for generation of ink vapor bubbles, the bubbles generating pressure forces equally directed both toward the nozzles to effect droplet ejection and toward the reservoir; and a one-way valve located in each channel, each valve being pivotally operative in response to the bubble generated pressure forces directed toward the reservoir to intercept and redirect said pressure forces toward the nozzles, so that the redirected forces increase droplet velocity and improve droplet directionality, wherein the one-way valve is a flap member having a pivotable end and a distal end, the flap member being pivotally mounted about the pivotable end and located on the lower surface of the channels upstream from the heating elements at a location between a position adjacent the heating elements and a position intermediate the heating elements and the reservoir, the distal end having a shape similar to the channel internal cross-sectioned shape and extending in a direction towards the nozzles, so that the bubble generated forces produced by selectively addressed heating elements which are directed toward the reservoir cause the flap member to pivot about the pivotable end and substantially block the pressure forces directed toward the reservoir with the channel shaped distal end of the flap member.

2. The printhead of claim 1 in which the heating elements are located in pits and the distal end of the flap member partially extends over the portion of the pit closer to the reservoirs, so that the bubbles produced by the heating cause the flap member to pivot.

3. The printhead of claim 1 in which the flap member is silicon dioxide having a predetermined thickness, said silicon dioxide flap member being formed from an etch resistant mask layer used to form the etched channel plate.

4. The printhead of claim 1 in which the channels have a triangular shape with an apex spaced above the heater plate and in which the pivotable ends of the flap members are interconnected by relatively narrow segments having the same thickness as the flap member, the flap members and interconnecting segments lying in contact with the thick film layer, so that the pivotable ends of the flap members torsionally pivot about the narrow segments and the distal ends of the flap members, each having a triangular shape similar to the channels, rotate toward the channel apexes.

* * * * *